United States Patent [19]

Richmond

[11] 4,401,577

[45] Aug. 30, 1983

[54] QUATERNARY AMMONIUM DIHYDROBORATES IN FABRIC SOFTENER FORMULATIONS

[75] Inventor: James M. Richmond, Naperville, Ill.

[73] Assignee: Akzona Incorporated, Asheville, N.C.

[21] Appl. No.: 351,374

[22] Filed: Feb. 23, 1982

Related U.S. Application Data

[63] Continuation-in-part of Ser. No. 190,550, Sep. 25, 1980, abandoned.

[51] Int. Cl.[3] ..... D06M 13/18; D06M 13/46

[52] U.S. Cl. ..... 252/8.8; 564/292; 564/291; 564/294; 564/295

[58] Field of Search ..... 252/8.8

[56] References Cited

U.S. PATENT DOCUMENTS

| | | | |
|---|---|---|---|
| 2,897,190 | 7/1959 | Gruber | 564/294 |
| 3,005,012 | 10/1961 | Mulloy | 564/292 |
| 3,445,440 | 5/1969 | Susi et al. | 564/294 |
| 3,914,496 | 10/1975 | Jorek et al. | 564/292 |
| 4,118,324 | 10/1978 | Steckelberg et al. | 252/8.8 |
| 4,136,039 | 1/1979 | Jager et al. | 252/8.8 |
| 4,139,477 | 2/1979 | Hayek et al. | 564/294 |
| 4,294,709 | 10/1981 | Anderson et al. | 252/8.8 |

FOREIGN PATENT DOCUMENTS

| | | | |
|---|---|---|---|
| 2246866 | 3/1973 | Fed. Rep. of Germany | 252/8.8 |
| 2543637 | 9/1976 | Fed. Rep. of Germany | 252/8.8 |
| 2746447 | 4/1978 | Fed. Rep. of Germany | 252/8.8 |

*Primary Examiner*—Maria Parrish Tungol

*Attorney, Agent, or Firm*—Francis W. Young; Daniel N. Christus

[57] ABSTRACT

This disclosure relates to fabric softening compositions containing quaternary ammonium dihydroborates and to methods of softening textiles employing such compounds and compositions. Such softening compositions have unusually and unexpectedly favorable stabilities in 3% dispersions in water.

9 Claims, No Drawings

QUATERNARY AMMONIUM DIHYDROBORATES IN FABRIC SOFTENER FORMULATIONS

BACKGROUND OF THE INVENTION

This application is a continuation-in-part of U.S. patent application Ser. No. 190,550, filed Sept. 25, 1980 now abandoned.

The present invention relates to a class of quaternary ammonium compounds. More particularly, this invention relates to a class of quaternary ammonium dihydroborate compounds and their use as fabric softeners. This invention further relates to fabric softening compositions containing such quaternary ammonium dihydroborates and to methods of softening textiles employing such compounds and compositions.

It has been long recognized in the art that certain quaternary ammonium compounds ("quats") impart "softness" to textiles. Of particular interest is a class of alkoxylated quaternary ammonium compounds wherein an oxyalkyl or a poly(oxyalkyl) group is bonded to the nitrogen. Such alkoxylated quaternary ammonium compounds have been generally found to exist as chloride salts.

One concern of users of such quaternary ammonium compounds is the freezing point of the product. It is desirable that fabric softening compounds have as low a freezing point as possible to reduce the necessity, for example, of utilizing heated railroad cars for transportation of the bulk compound or using heated holding tanks and transfer lines to assure that the compound remains a liquid. If a product having a lower freezing point is produced, the amount of energy required to transport and store that product is minimized. Such products are also generally cold water dispersible, negating the need to heat water to make diluted solutions or dispersions of the concentrated softener.

A further concern is the stabilities of the quat dispersions. The known dispersions, such as those comprising a quaternary ammonium chloride in water or a quaternary ammonium acetate in water, with break up into layers comprising either the water or softener alone after the passage of time at room temperatures or upon exposure to a freeze-thaw cycle. This separation lessens the effectiveness of the softener in that one layer contains an excessive amount of the softener and the larger aqueous layer contains no softener at all.

Another concern when quaternary ammonium compounds are utilized as fabric softening compounds is the solvent. Ideally, compounds relatively free of volatile, flammable and/or odor producing solvents that serve only as a reaction media and have no softening effect are preferred.

A further concern when using quaternary ammonium compounds relates to the ease of formulating various compositions containing such compounds. In this regard it is highly desirable to employ cold water dispersible quaternary ammonium compounds.

An object of the present invention is to provide a class of quaternary ammonium compounds which are effective fabric softeners. In addition it is an object of the present invention to provide a class of quaternary ammonium compounds which in addition to softening fabrics produce desirable rewet and antistatic characteristics in treated fabrics.

Furthermore, an object of the present invention is to provide a class of quaternary ammonium compounds which exhibit lower freezing points or "increased liquidity" compared to prior art compounds.

An additional object is a class of compounds relatively free of volitile, flammable and/or odor producing solvents that serve only as a reaction media and have no value for providing softening, and a softening composition that has unexpectedly high stability at room temperatures and above, and unexpected stability upon exposure to one or more freeze-thaw cycles.

It is also an object of the present invention to provide a class of compounds which are readily formulated into fabric softening compositions. In addition it is an object of the present invention to provide quaternary ammonium compounds which are cold water dispersible.

SUMMARY OF THE INVENTION

The compounds of the present invention comprise 2–6% of a compound represented by the following formula:

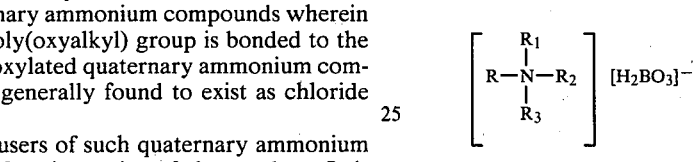

(I)

and 94–98% water, wherein R is selected from the class consisting of aliphatic radicals containing from about 6 to about 22 carbon atoms, a $$R_5\text{-}(C_mH_{2m})\text{-}$$

group wherein $R_5$ is alkoxy containing from 6 to 22 carbon atoms and m is an integer of from 2 to 6, and a $$R_6\text{-}(OCH_2\overset{\overset{\displaystyle R'}{|}}{C}H)_z\text{-}$$

group, wherein $R_6$ is alkyl containing from 1 to 20 carbon atoms, z is an integer of from 1 to 10 and each R′ is independently hydrogen or methyl; each $R_1$, which may be the same or different, is independently selected from the class consisting of $$(C_2H_3R''O)_xH$$

groups, wherein x is an integer of from 1 to 20 and each R″ is independently hydrogen or methyl; $R_2$ is methyl or a group selected from the class represented by $R_1$; $R_3$ is a group selected from the class represented by R or $R_2$.

DESCRIPTION OF THE INVENTION

The long chain aliphatic radicals represented by R and $R_3$ contain from about 6 to about 22 carbon atoms. Preferably, the aliphatic radicals contain from about 12 to about 18 carbon atoms. The aliphatic groups may be either "straight chain" or "branched" aliphatic radicals. In addition, the aliphatic radicals may be either saturated groups, and thus alkyl, or may be unsaturated groups, and thus alkenyl. It is most preferred that the aliphatic radicals represented by R and $R_3$ be alkyl or alkenyl containing from about 12 to about 18 carbon atoms. Typically, such radicals are derived from, for example, animal fatty acids such as tallow fatty acids or grease acids, hydrogenated tallow fatty acids, and coconut fatty acids.

It is preferred that each x in the $-(C_2H_3R''O)_xH$ groups represented by $R_1$ be from 1 to about 5. It is most preferred that the sum of all the x's in the groups represented by $R_1$ and $R_2$ in either the compounds of formula (I) or formula (II) be equal to two. It is further preferred that R' is methyl. In addition it is preferred that R'' is hydrogen. It is to be understood that the $-(C_2H_3R''O)_xH$ radicals represented by $R_1$ containing more than one alkylene moiety, i.e. x is greater than one, may contain alkylene moieties wherein all the R''s are the same or different. If x is two, radicals represented by $R_1$ include for example:

$$-CH_2CH_2O-CH_2\overset{CH_3}{\overset{|}{C}}H-OH,\ -CH_2\overset{CH_3}{\overset{|}{C}}HO-CH_2CH_2OH,$$

$$-CH_2CH_2O-CH_2CH_2OH,$$

$$-CH_2\overset{CH_3}{\overset{|}{C}}HO-CH_2\overset{CH_3}{\overset{|}{C}}HOH \quad \text{and the like.}$$

If R is a $R_5-(C_mH_{2m})-$ group it is preferred that m is 3 and $R_5$ is alkoxy containing from 10 to 18 carbon atoms.

The preferred embodiment of the compound of formula (I) is represented by the formula:

$$\left[R-\overset{\overset{R_1}{|}}{\underset{\underset{R_3}{|}}{C}}-R_1\right]^+ [H_2BO_3]^- \qquad \text{(II)}$$

wherein R and $R_3$ are selected from the class consisting of aliphatic radicals containing from about 8 to about 22 carbon atoms and $R_1$ is a $$-(CH_2CH_2O)_xH$$

group wherein x is an integer of from 1 to 5. The most preferred value of x is 1.

The compounds of formula (I) may be prepared in accordance with the following procedure:

An amine of the formula $$R-N\begin{matrix}M\\M'\end{matrix} \qquad \text{(III)}$$

wherein R is above defined, M is hydrogen or methyl and M' is hydrogen, methyl or an aliphatic radical containing from about 6 to about 22 carbon atoms, is treated with boric acid. The resulting mixture is treated with an alkylene oxide(s) of the formula $$\underset{O}{CH_2-\overset{R'''}{\overset{|}{C}}H} \qquad \text{(IV)}$$

wherein R''' is hydrogen or methyl; to produce the N-alkoxylated quaternary ammonium dihydroborates of formula (I). A surprising aspect of this process for preparing the compounds of the present invention is that unlike similar compounds wherein the anion is chloride, acetate, phosphate, etc., the reaction of the amine and boric acid does not produce an intermediate amine salt. The formation of an intermediate amine salt was previously deemed necessary in order to produce an alkoxylated product.

Although it is preferred to employ boric acid, other sources of dihydroborate may be employed. Borate salts such as sodium tetraborate and borate esters such as trimethylborate which are readily hydrolyzed to boric acid may be employed. However if borate salts or borate esters are employed, water must be present in the reaction mixture.

The above procedure is generally carried out in a closed reaction vessel at a temperature of from 40°-110° C. with a temperature of 70°-110° C. being preferred and under a pressure in a range of 5-60 psig with 20 psig being preferred. Although a catalyst is not necessary, an acid catalyst such as p-toluenesulfonic acid, methane sulfonic acid, sulfuric acid and the like, may be employed. If a catalyst is employed, p-toluenesulfonic acid is preferred. Although not narrowly critical, the time of reaction should be sufficient to permit the reaction to proceed to completion. A reaction time period of 6 hours is generally sufficient. The molar ratio between the amine of formula (VII) and boric acid may vary, but about 1 mole of boric acid is preferably reacted with about 1 mole of amine. It is most preferred to employ 1.25-1.50 moles of boric acid per mole of amine.

It should be noted that unlike the procedures for preparing quaternary ammonium chlorides, acetates, etc., a solvent is not required in the preparation of the dihydroborates. However, if desired a solvent which will not react with the reactants may be employed. Illustrative of such solvents include for example, water, mineral oil, alcohols, such as isopropanol, ethylene glycol, hexylene glycol and the like, and esters of acetic acid. If a solvent is to be utilized, it is preferred to employ water or isopropanol. The amines of formula (III) employed in accordance with the above procedures are either commercially available or prepared in accordance with known techniques.

The following illustrative, non-limiting examples will serve to further demonstrate to those of ordinary skill in the art the manner in which specific compounds within the scope of this invention can be prepared.

EXAMPLE 1

A one liter Carp. 20 steel autoclave was charged with 400 g. (0.800 g. mole) of di(hydrogenated tallow)amine [Armeen ® 2HT from Armak Company, Chicago, Ill.], 74.2 g. (1.201 g. mole) of boric acid, 23.7 g. (3.7% of total charge) of isopropyl alcohol and 141 g. (3.2 g. mole) of ethylene oxide. The resulting mixture was heated to 100° C. and digested until the reactor head pressure leveled off at about 5 psig. to yield a product having the following analysis: 91.8% solids, 5.1% ethylene glycol, 5.0% diethylene glycol, 1.0% triethylene glycol, 0.20 meq/g. (10%) free amine, and 1.05 meq/g. (68.2%) quaternary dihydroborate. NMR analysis (excluding glycols) revealed about 1.7 moles of ethylene oxide per mole of amine/quaternary mixture. Analyses of the solids residue for glycols gave 4% ethylene glycol, 4% diethylene glycol, and 1% triethylene glycol.

EXAMPLE 2

A one liter autoclave was charged with 400 g. (0.855 g. mole) of ditallowamine [Armeen® 2T from Armak Company, Chicago, Ill.], 79.3 g. (1.283 g. mole) of boric acid, 27 g. (3.89% of total charge) of isopropyl alcohol and 188.1 g. (4.275 g. mole) of ethylene oxide. The resulting mixture was heated to 100° C. and digested until the reactor head pressure decayed to a constant value to yield a product having the following analyses: 88.4% solids, 1.09 meq/g. (67.3%) quaternary dihydroborate, 0.12 meq/g. (5.6%) of free amine, 4.7% ethylene glycol, 6.3% diethylene glycol, 1.5% triethylene glycol, and nil tetraethylene glycol.

EXAMPLE 3

A one liter Carp. 20 steel autoclave was charged with 400 g. (0.752 g. mole) of N-methyl-N-di(hydrogenated tallow)amine [Armeen® M2HT from Armak Company, Chicago, Ill.], 46.48 g. (0.752 g. mole) of boric acid, and 40.64 g. (6.3% of total charge) of water. The resulting mixture was heated to 80° C. and 132 g. (3.01 g. mole) of ethylene oxide then added. The reaction mixture was heated at 80°-90° C. until the reactor pressure decayed to 0 psig. to yield a product having the following analyses: 0.983 meq/g. (75.7%) quaternary dihydroborate, and 0.250 meq/g. free amine (13.3%) and nil acidic material.

EXAMPLE 4

A one liter 316 SS autoclave was charged with 400 g. (0.752 g. mole) of N-methyl-N-di(hydrogenated tallow-)amine [Armeen® M2HT from Armak Company, Chicago, Ill.], 0.71 g. of para-toluenesulfonic acid monohydrate, 40.6 g. of water, and 78.1 g. (0.752 g. mole) of trimethylborate. The resulting mixture was heated to 80° C. and 99.3 g. (2.26 g. mole) of ethylene oxide then added. The reaction mixture was heated until the pressure of the vessel was no longer decreasing to yield a product having the following analyses: 0.979 meq/g. (66.6%) quaternary dihydroborate, 0.248 meq/g. (13.2%) free amine, nil acidic material, 5.7% water, and 77.7% solids.

EXAMPLE 5

To a one liter Carp. 20 autoclave was charged with 400 g. (0.800 g. mole) of ditallowamine [Armeen® 2T from Armak Company, Chicago, Ill.], 49.46 g. (0.800 g. mole) of boric acid, 43.25 g. of water and 7.6 g. of para-toluenesulfonic acid monohydrate. The reactor was sealed, heated to 70° C., and 176 g. (4.0 g. mole) of ethylene oxide was added under 25 psig. maximum pressure. The resulting mixture was digested until a pressure of 0 psig. was obtained to yield a product having the following analyses: 0.12 meq/g. (6.53%) free amine, nil acidic material, 91.1% solids, and 1.054 meq/g. (82.4%) quaternary dihydroborate.

EXAMPLE 6

A one liter Carp. 20 steel autoclave was charged with 400 g. (0.757 g. mole) of N-methyl-N-di(hydrogenated tallow)amine [Armeen® M2HT from Armak Company, Chicago, Ill.], 31.2 g. (0.505 g. mole) of boric acid, 40.9 g. of water and 7.2 g. of paratoluenesulfonic acid monohydrate. The reactor was sealed, heated to 80° C., and ethylene oxide added incrementally, allowing for complete digestion between additions. Results of analyses are given below:

TABLE I

| Total moles of ethylene oxide added/mole amine | meq/g. Quaternary Dihydroborate | meq/g. Free Amine | meq/g. Acidic Material |
|---|---|---|---|
| 1 | 0.592 | 0.879 | 0 |
| 2 | 0.717 | 0.704 | 0 |
| 3 | 0.794 | 0.590 | 0 |
| 4 | 0.881 | 0.425 | 0 |
| 5 | 0.857 | 0.369 | 0 |
| 6 | 0.81 | 0.385 | 0 |

A final sample was analyzed as 95.7% solids, 7% water, and 14.4% nonionic.

EXAMPLE 7

To a one liter 316 SS autoclave was charged with 308 g. (0.617 g. mole) of ditallowamine [Armeen® 2T from Armak Company, Chicago, Ill.], 38.15 g. (0.617 g. mole) of boric acid and 5.88 g. (0.031 g. mole) of para-toluenesulfonic acid monohydrate. The resulting mixture was heated to 70° C. and 136 g. (3.09 g. mole) of ethylene oxide was added at 20–25 psig. maximum pressure. The resulting mixture digested at 70° C. until 0 psig. was obtained to yield a product having the following analyses: 1.028 meq/g. (80.2%) quaternary dihydroborate, 0.184 meq/g. (9.2%) free amine, 95.8% solids, and nil acidic material.

EXAMPLE 8

A 20 gallon steel reactor was charged with 76 lbs. (0.15 lb. mole) of ditallowamine [Armeen® 2T from Armak Company, Chicago, Ill.], and 13.8 lb. (0.22 lb. mole) of boric acid. The resulting mixture was heated to 70° C., the system purged three times with nitrogen, and vented to 2 psig. on the last purge. To the reaction mixture was then added 26.4 lb. (0.60 lb. mole) of ethylene oxide over a 2½ hour period. The resulting mixture was allowed to digest at 70° C. for twelve hours until the reactor pressure decayed to 2 psig to yield a product having the following analyses: 1.246 meq/g. (86.2%) quaternary dihydroborate, 0.088 meq/g. (5.2%) free amine, nil acidic material, 9.8 pH, Gardner color 7, 5.1% water, 2.8 moles of ethylene oxide per mole of amine/quat mixture (excluding glycols), 5.8% ethylene glycol, and 3.8% diethylene glycol.

EXAMPLE 9

A 20 gallon steel autoclave was charged with 76.0 pounds (0.15 lb. mole) of di-(hydrogenated tallow)amine [Armeen® 2HT from Armak Company, Chicago, Ill.], and 13.6 pounds (0.22 lb. mole) of boric acid. The reactor was sealed, purged three times with nitrogen and vented to 0 psig. To the reaction mixture was then added 26.4 lb. (0.6 lb. mole) of ethylene oxide over a four-hour addition period as the temperature of the vessel was held at 66°-70° C. The resulting mixture was allowed to digest until the reactor pressure had decayed to 0 psig to yield a product having the following analyses: 95.6% solids, 1.209 meq/g. (85.2%) quaternary borate, 0.032 meq/g. (2.0%) free amine, nil acidic material, 9.9 pH, 6.3% ethylene glycol, 7.2% diethylene glycol, m.t. 26° C. Nmr analysis showed 3.0 moles of ethylene oxide per mole of quaternary dihydroborate, exclusive of the ethylene glycol and diethylene glycol found to be present.

EXAMPLE 10

A two-liter 316 SS autoclave was charged with 500 g. (1.89 g. mole) of distilled tallowamine [Armeen® TD from Armak Company, Chicago, Ill.], 116.7 g. (1.89 g. mole) of boric acid, 17.9 g. of paratoluenesulfonic acid monohydrate, and 221 g. of isopropyl alcohol. The autoclave was sealed and the contents heated to 90° C. To the reaction mixture was added 249 g. (5.65 g. mole) of ethylene oxide and resulting mixture was heated until the pressure reached 7 psig. to yield a product having the following analyses: nil acidic material, 0.492 meq/g. (17.4%) free amine, and 51.6% (1.125 meq/g.) quaternary dihydroborate. An additional 1.51 g. mole (66.5 g.) of ethylene oxide was added to the reaction mixture and digestion continued until a pressure of 6 psig was obtained to yield a product having the following analyses: 1.256 meq/g. (57.6%) quaternary dihydroborate, 0.126 meq/g. (4.4%) free amine, nil acidic material, 76.4% solids, and 10.75 pH.

EXAMPLE 11

A one liter Carpenter 20 steel autoclave was charged with 300 g. (1.123 g. mole) of distilled tallowamine [Armeen® TD from Armak Company, Chicago, Ill.], 104.2 g. (1.686 g. mole) of boric acid and 101 g. of isopropyl alcohol. The resulting mixture was heated to 80° C. as 198 g. (4.49 g. mole) of ethylene oxide was added. The resulting mixture was then heated until the pressure decayed to 0–3 psig. to yield a liquid product having the following analyses: 70.4% solids, 1.240 meq/g. (62.6%) quaternary dihydroborate, 0.191 meq/g. (5.1%) free amine, nil acidic material, 3.9% ethylene glycol, 2.4% diethylene glycol, 0.2% triethylene glycol, and nil tetraethylene glycol.

EXAMPLE 12

A one liter Parr autoclave was charged with 208.5 g. (0.564 mol) of dicocoamine [Armeen® 2C from Armak Company, Chicago, Ill.], 43.6 g. (0.704 mol) of boric acid, 43.7 g. (0.704 mol) of ethylene glycol and 39.0 g. of mineral oil. The resulting mixture was heated to 90° C., the system purged twice with nitrogen (45 psig.), and vented to 8 psig. on the last purge. To the reaction mixture was then added 113. g. (2.56 mol) of ethylene oxide over a 3 hour period. The resulting mixture was allowed to digest at 90° C. for 4.7 hours to yield a product having the following analysis: 1.19 meq/g. (61.9%) quaternary dihydroborate, 0.03 meq/g. (1.2%) free amine, and nil acidic material.

EXAMPLE 13

A one liter Carpenter 20 steel autoclave was charged with 400 g. (0.757 g. mole) of N-methyl-N-di(hydrogenated tallow)amine, 46.79 g. (0.757 g. mole) of boric acid, 40.91 g. (2.27 g. mole) of water and 7.2 g. (0.0379 g. mole) of paratoluene-sulfonic acid. The resulting mixture was heated to 80° C., after which time ethylene oxide was added incrementally, allowing for complete digestion between additions. Results are shown in Table II.

TABLE II

| Total moles of ethylene oxide added/mole amine | meq/g. Quaternary Dihydroborate | meq/g. Free Amine |
|---|---|---|
| 1 | .4865 | .975 |
| 2 | .6415 | .812 |
| 3 | .7457 | .641 |
| 4 | .9138 | .388 |
| 5 | .9828 | .297 |
| 6 | 1.015 | .167 |
| 7 | .9974 | .131 |

EXAMPLE 14

A one liter 316 SS autoclave was charged with 400 g. (0.792 g. mole) of di-(hydrogenated tallow)amine [Armeen 2HT], 48.96 g. (0.792 g. mole) of boric acid and 72.07 g. (0.783 g. mole) of glycerine. The mixture was heated to 100° C. and ethylene oxide added incrementally, allowing for complete reaction between additions. Results of analyses are shown below:

TABLE III

| Total moles of ethylene oxide added/ mole amine | meq/g. Quaternary Dihydroborate | meq/g. Free Amine | meq/g. Acidic Material | pH | Gardner Color |
|---|---|---|---|---|---|
| 2 | .048 | 1.001 | .282 | 8.3 | 1–2 |
| 4 | .824 | 0.362 | 0 | 10 | 4–5 |
| 6 | .715 | 0.351 | 0 | 11.3 | 3 |

A final sample analyzed as 93.3% solids, and 34.2% nonionic.

EXAMPLE 15

A one liter Parr autoclave was charged with 219.5 g. (0.918 mol) of N,N-dimethylcocoamine [Armeen® DMCD from Armak Company, Chicago, Ill.], 71.0 (1.15 mol) of boric acid and, 71.3 (1.15 mol) of ethylene glycol. The resulting mixture was heated to 90° C., the system purged twice with nitrogen (45 psig.), and vented to 8 psig. on the last purge. To the reaction mixture was then added 83 g. (1.89 mol) of ethylene oxide over a 2.25 hour period. The resulting mixture was allowed to digest at 90° C. for 3.25 hours and cooled to 60° C. to yield a product having the following analysis: 1.95 meq/g. (67.5%) quaternary dihydroborate, 0.11 (2.6%) free amine, and nil acidic material.

EXAMPLE 16

A one liter Parr autoclave was charged with 215.0 g. (1.075 mol) of cocoamine [Armeen® CD from Armak Company, Chicago, Ill.], 83.1 g. (1.34 mol) of boric acid, 83.4 g. (1.34 mol) of ethylene glycol and 30 g. of isopropylalcohol. The resulting mixture was heated to 85° C., the system purged twice with nitrogen (45 psig.), and vented to 8 psig. on the last purge. The reaction mixture was heated to 90° C. and then 244 g. (5.55 mol) of ethylene oxide were added. The resulting mixture was allowed to digest at 90° C. for 12 hours to yield a product having the following analysis: 1.55 meq/g. (61%) quaternary dihydroborate, 0.25 (7.2%) free amine, and nil acidic material.

EXAMPLE 17

A one liter Parr autoclave was charged with 193.3 g. (0.743 mol) of 4-oxa-heptadecylamine [Armeen® EA-13 from Armak Company, Chicago, Ill.], 57.5 (0.929 mol) of boric acid, 57.3 g. (0.929 mol) of ethylene glycol and 25.1 g. of isopropyl alcohol. The resulting mixture was heated to 75° C., the system purged twice with nitrogen (45 psig.), and vented to 8 psig. on the last purge. To the reaction mixture was then added 134 g. (3.04 mol) of ethylene oxide over a 3 hour period. The resulting mixture was allowed to digest at 75° C. for 4.5 hours to yield a product having the following analysis: 0.819 meq/g. (62.2%) quaternary dihydroborate, 0.190 meq/g. (6.6%) free amine, and nil acidic material.

Also, provided by the present invention is a method for softening fabrics by contacting said fabric with an effective softening amount of a compound of the present invention or a composition containing such compounds in order to impart "softness" quality to the fabric. The term "effective softening amount" refers to that quantity of a compound or composition of the present invention sufficient to produce desirable softening, antistat and/or rewet properties in the treated textile fabrics. Such quantities are readily ascertained by one of ordinary skill in the art. Typically the fabrics are contacted with the compounds or compositions which are in the form of a solution.

The compounds of the present invention were evaluated with respect to their fabric softening properties. For the purposes of the evaluations, the following compounds alkoxylated quaternary ammonium dihydroborates were evaluated as aqueous compositions:

| COMPOSITION NO. | INGREDIENTS | % |
|---|---|---|
| I | Poly(oxyethylene)(6)ditallowylammonium dihydroborate | 2.7 |
| | Methyl-poly(oxyethylene)(15)cocoammonium chloride | 0.3 |
| | Water | 97.0 |
| II | Poly(oxyethylene)(5)di(hydrogenated-tallowyl)ammonium dihydroborate | 2.7 |
| | Methyl-poly(oxyethylene)(15)cocoammonium chloride | 0.3 |
| | Water | 97.0 |
| III | Poly(oxyethylene)(4)di(hydrogenated-tallowyl)ammonium dihydroborate | 2.7 |
| | Methyl-poly(oxyethylene)(15)cocoammonium chloride | 0.3 |
| | Water | 97.0 |
| IV | Poly(oxyethylene)(6)ditallowylammonium dihydroborate | 3.0 |
| | Water | 97.0 |
| V | Poly(oxyethylene)(4)di(hydrogenated-tallowyl)ammonium dihydroborate | 3.0 |
| | Water | 97.0 |
| VI | Poly(oxyethylene)(4)ditallowylammonium dihydroborate | 2.7 |
| | Methyl-poly(oxyethylene)(15)cocoammonium chloride | 0.3 |
| | Water | 97.0 |
| VII | Dimethyl-bis(2-hydroxyethyl)cocoammonium dihydroborate | 3.0 |
| | Water | 97.0 |
| VIII | Poly(oxyethylene)(5)cocoammonium dihydroborate | 3.0 |
| | Water | 97.0 |
| IX | Poly(oxyethylene)(4)ditallowylammonium dihydroborate | 2.7 |
| | Methyl-poly(oxyethylene)(15)cocoammonium chloride | 0.3 |
| | Water | 97.0 |

The percent indicates percentage by weight of an aqueous composition.

Fabric softness was evaluated by an experienced panel of persons feeling treated and untreated fabrics and comparing the softness of the treated fabric with an untreated control fabric. For purposes of determining the fabric softening properties of the compounds of the present invention, cotton towels were evaluated following 1 and 5 wash-dry cycles. The fabrics were treated during each cycle. For comparison, control fabrics were run for 1 and 5 wash-dry cycles without any softening agent being added to any cycle. The compounds of the present invention were found to significantly soften the fabrics tested when compared to untreated fabrics.

In addition the compounds of the present invention were evaluated with respect to their rewet characteristics (a measure of the absorbancy of fabrics). The rewet characteristics were judged by measuring the height to which water rose in a strip of fabric whose end was immersed in water. A cotton strip, 2"×18" is suspended into a 1 liter graduated glass cylinder containing a 3" depth of a 0.1% solution of Drimarene Bordeaux Z-BL dye. About one inch of the strip is immersed in the solution. The height of the coloration produced by the dye on the cloth strip is measured after 5, 10, 20 and 30 minutes. The higher and faster the dye rises, the greater the rewet or absorbancy of the sample fabrics. The results in Table IV and V illustrate the rewet characteristics of fabrics treated with the compounds of the present invention and untreated fabrics (controls). The results are the average of duplicate samples.

TABLE IV

| composition used in treatment of fabric | dye height (cm.) time of measurement (min.) 5 | 10 | 20 | 30 |
|---|---|---|---|---|
| control (untreated) | 12.5 | 15.8 | 19.8 | 23.2 |
| I | 4.8 | 5.0 | 7.5 | 8.5 |
| II | 3.8 | 4.6 | 5.6 | 6.5 |
| III | 4.0 | 5.0 | 6.0 | 6.8 |

TABLE V

| composition used in treatment of fabric | dye height (cm.) time of measurement (min.) 5 | 10 | 20 | 30 |
|---|---|---|---|---|
| control (untreated) | 13.0 | 16.6 | 21.2 | 24.2 |
| IV | 4.5 | 5.3 | 6.8 | 8.0 |
| V | 3.6 | 4.6 | 6.0 | 6.8 |
| VI | 3.8 | 4.8 | 5.5 | 6.4 |

TABLE VI

| composition used in treatment of fabric | dye height (cm.) time of measurement (min.) 5 | 10 | 20 | 30 |
|---|---|---|---|---|
| control (untreated) | 13.0 | 16.0 | 21.5 | 25.0 |
| VII | 10.0 | 12.6 | 16.0 | 18.0 |
| VIII | 10.6 | 13.6 | 17.2 | 19.6 |
| IX | 5.2 | 6.5 | 7.8 | 8.8 |

It has been found that the compounds of the present invention when applied to fabric will increase the antistatic properties of the fabric. The antistatic characteristics were measured by comparing the static ("cling"

tendency) properties of treated fabrics with an untreated fabric. The treated fabrics were given a rating relative to the control. For nylon control fabrics, a rating of 10 is given, for 100% polyester control fabrics, a rating of 8 is given and for a 65/35 polyester/cotton fabric a rating of 5 is given. A rating for the treated fabric less that the rating for the control is an indication of the antistatic characteristics of the composition employed to treat the fabrics. The results in Table VI illustrate the rating found for various fabrics treated with compositions containing the compounds of the present invention.

TABLE VII

| composition used in fabric | Antistatic Rating Fabric | | |
|---|---|---|---|
| | 100% Nylon | 100% Polyester | 65/35 Polyester/Cotton |
| control (untreated) | 10 | 8 | 5 |
| I | 3 | 1 | 1 |
| II | 7 | 4 | 2 |
| III | 1 | 1 | 1 |
| IV | 4 | 2 | 1 |
| V | 1 | 1 | 1 |
| VI | 2 | 1 | 1 |
| VII | 1 | 1 | 1 |
| VIII | 3 | 2 | 1 |
| IX | 1 | 1 | 1 |

In evaluating the compounds of the present invention with respect ot their rewet and antistatic characteristics, fabrics treated with compositions containing the compounds of the present invention were run for 5 wash-dry cycles before testing. The fabrics were treated with a compound or composition of the present invention during each cycle. For comparison, control fabrics were run for 5 wash-dry cycles without any "softening" agent being added to any cycle.

The above examples illustrate that the compounds of the present invention and compositions containing such compounds are effective in "softening" textile fabrics.

The compounds of the present invention may be employed in fabric softening compositions, such as, for example: rinse cycle fabric softening compositions, liquid detergent fabric softening compositions and dryer application fabric softening compositions. The compounds of the present invention may be employed alone or in combination with one or more other fabric softening compounds as the active fabric softening ingredient in such compositions.

Rinse cycle fabric softening compositions contain from 1—10 parts by weight of at least one compound of this invention and from 90–99 parts by weight of adjuvants, for example, from about 0.2–0.5 parts by weight optical brightner, from about 0–5 parts by weight of a dispersant and from about 84.5–98.8 parts by weight of inert liquid extender preferably water, all parts being by weight of the total composition. Preferably, rinse cycle fabric softening compositions of this invention contain from 3–6 parts by weight of at least one compound of this invention, together with adjuvants.

Liquid detergent fabric softening compositions contain from about 3–10 parts by weight of at least one compound of this invention and from about 90–97 parts by weight of adjuvants, for example, from about 25–35 parts by weight of a non-ionic detergent such as an ethoxylated alkyl phenol or ethoxylated alcohol etc., from about 5–15 parts by weight ethanol, from about 4–6 parts by weight triethanolamine, from about 0.1–1 parts by weight sulfuric acid, from about 0–5 parts by weight of a dispersant and from about 28–62.9 parts by weight of an inert liquid extender, preferably water, all parts being by weight of the total composition. Preferably, liquid detergent fabric softening compositions contain from 5–7 parts by weight of at least one compound of this invention, together with adjuvants.

Liquid detergent fabric softening compositions, such as described above, may contain in addition to a non-ionic detergent, an anionic detergent such as a sodium alkyl benzene sulfonate or a sodium xylene sulfonate etc. Such compositions should contain a total of from about 25–35 parts by weight of non-ionic and anionic detergents.

Dryer application fabric softening compositions contain from 50–80 parts by weight of at least one compound of this invention and from 20–50 parts by weight of adjuvants such as for example, fatty esters, fatty alcohols and/or sugar esters. Preferably, dryer application fabric softening compositions of this invention contain from 70–75 parts by weight of at least one compound of this invention.

The compositions are prepared by admixing the active ingredients (compound of this invention) with an adjuvant including, diluents, extenders, carriers, and conditioning agents to provide compositions in the form of solutions, dispersions or emulsions.

The fabric softening compositions of this invention may contain as a conditioning agent one or more surface-active agents in amounts sufficient to render a given composition more readily dispersable in water. The incorporation of a surface-active agent into the compositions greatly enhance their efficacy. By the term "surface-active agents," it is understood that wetting agents, dispersing agents, suspending agents and emulsifing agents are included therein. Anionic, cationic and non-ionic agents can be used with equal facility.

Other components appropriate to the type of compositions being formulated may also be present. Such components are preservatives, bactericides, whether effective to protect the composition or to treat fabrics, viscosity controllers, coloring and perfuming materials and the like.

Another desirable characteristic of the compounds of the present invention is the fact that they readily form stable emulsions and thereby may be readily formulated into stable aqueous compositions. This property of being cold-water dispersible is generally unexpected for quaternary ammonium compounds and is most desirable by users of such compounds. In addition, emulsions and formulated aqueous compositions containing compounds of the present invention are stable to heat and freeze-thaw cycles. What is meant by "stable to freeze-thaw cycles" in the context of the present application is that the dilute dispersion formed upon mixing of a 2–6% solution of the quat in water will remain a homogeneous liquid after it has been frozen and then thawed.

Proof of the present invention's unexpected stability to heat and to freeze-thaw cycles was shown in comparitive testing of three quats having dissimilar anions. The three quats tested were bis(2-hydroxyethyl)ditallowammonium dihydroborate, bis(2-hydroxyethyl)-ditallowammonium chloride, and bis(2-hydroxyethyl)-ditallowammonium acetate. The formula of the cation of each of the above compounds is:

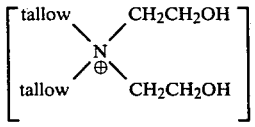

wherein the "tallow" alkyl radical is a mixture of alkyl groups containing mostly 18-carbon alkyl groups, as for example $C_{18}H_{35}$, and also containing fourteen- and sixteen-carbon alkyl groups. Three percent (weight) of each of the three quats was blended with water to form a quat-water dispersion, and each of the three dispersions was subjected to freeze-thaw cycles and placed in room temperature, 120° F., and 140° F. ambients and examined after 24 hours, 72 hours, 1 week, and 2 weeks. Subjective ratings, from most favorable to unfavorable, were: okay, very slight oil on top, slight oil on top, oil on top, top broken, and broken. In the freeze-thaw cycle, the dispersion is frozen and then returned to room temperature. Table VIII demonstrates the results of these tests, and that the dihydroborate is unexpectedly superior to the quats having one of the other two anions, and not suggested in any of the known prior art. The increased stability is particularly important in view of the wide temperature variations to which commercial softening dispersions are subjected during their transportation from producer to marketer.

TABLE VIII

| | 3% Solids Stabilities | | |
|---|---|---|---|
| | Dihydroborate | Anion/acetate | Chloride |
| ROOM TEMP. | | | |
| 24 hrs. | OK | slight oil on top | OK |
| 72 hrs. | OK | slight oil on top | OK |
| 1 week | OK | oil on top | OK |
| 2 weeks | OK | oil on top | OK |
| 120° F. | | | |
| 24 hrs. | OK | slight oil on top | slight oil on top |
| 72 hrs. | OK | slight oil on top | slight oil on top |
| 1 week | OK | oil on top | top broken |
| 2 weeks | very slight oil on top | oil on top | top broken |
| 140° F. | | | |
| 24 hrs. | OK | slight oil on top | very slight oil on top |
| 72 hrs. | very slight oil on top | oil on top | broken |
| 1 week | slight oil on top | oil on top | broken |
| 2 weeks | oil on top | oil on top | broken |
| Freeze Thaw (10° F.) (Room temp) | | | |
| 1 cycle | OK | slight oil on top | creamy & striated |
| 2 cycles | OK | slight oil on top | creamy & striated |
| 3 cycles | OK | slight oil on top | creamy & striated |

Table IX demonstrates the efficacy of a 3% dispersion of the dihydroborate in water as a fabric softener. A panel scored the present quat as a softener compared to an untreated control cloth and a commonly used, commercially available fabric softener, Varisoft 222-90, Rewet Characteristics were also tested in accordance with the rewet test procedure described hereinabove.

TABLE IX

| | One Application As Softeners | | |
|---|---|---|---|
| | Panel One | Panel Two | Total Points |
| Varisoft 222-90 | 12 | 15 | 27 |
| Dihydroborate | 9 | 10 | 19 |
| Control | 9 | 5 | 14 |
| | Five Applications As Softeners | | |

TABLE IX-continued

| | Panel One | Panel Two | Total Points |
|---|---|---|---|
| Varisoft 222-90 | 13 | 16 | 29 |
| Dihydroborate | 16 | 13 | 29 |
| Control | 1 | 1 | 2 |
| | Rewet | | |
| | 5 Min | 10 Min | 20 Min | 30 Min |
| Varisoft 222-90 | 5.1 | 6.1 | 8.1 | 9.4 |
| Dihydroborate | 5.1 | 5.6 | 7.3 | 8.5 |
| Control | 10.7 | 14.3 | 18.5 | 20.7 |

As previously mentioned, the quaternary ammonium dihydroborate compounds of the present invention are less corrosive to ferrous and stainless steel than similar comounds which are chloride salts. The fact that the compounds of the present invention are less corrosive than similar chloride compounds is unexpected and advantageous to the art.

Another advantageous and unexpected characteristic of the compounds of the present invention is that the pH of the quaternary ammonium dihydroborates is about a pH 10. This enables one to employ the borates of the present invention as starting materials for the production of quaternary ammonium compounds containing anions other than dihydroborate.

In addition to the above mentioned uses, the compounds of this invention also may be useful as precipitants and carriers for use in the manufacture of antibiotics. The compounds may also be used as combing aids and hair conditioners and in paper making as softeners, debonders and antistatic agents. Furthermore, the compounds may be used as processing aids in foundries, in metal-working as emulsifiers and corrosion inhibitors and in surface modified clays, paints, oils and lubricants. In addition, the compounds of this invention may be used in drilling mud compositions and as foaming and silt suspending agents. A particular advantage is the use of the compounds of this invention in cosmetics wherein they would be a desirable replacement for quaternary ammonium chlorides.

Although the present invention has been described in conjunction with preferred embodiments, it is also understood that modifications and variations may be restored to without departing from the spirit and scope of the invention as those skilled in the art readily understand.

What is claimed is:

1. A fabric softening composition comprising between 2% and 6% of the compound of the formula:

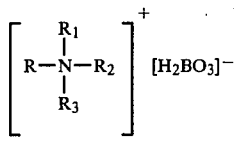

wherein R is selected from the class consisting of aliphatic radicals containing from about 6 to about 22 carbon atoms, a $$R_5\text{-}(C_mH_{2m})\text{-}$$

group wherein $R_5$ is alkoxy containing from 6 to 22 carbon atoms and m is an integer of from 2 to 6, and a $$R_6\text{-}(OCH_2\overset{\overset{R'}{|}}{C}H)_z\text{-}$$

group, wherein $R_6$ is alkyl containing from 1 to 20 carbon atoms, z is an integer of from 1 to 10 and each R′ is independently hydrogen or methyl; $R_1$ is independently selected from the class consisting of $$\text{-}(C_2H_3R''O)_x\text{-}H$$

groups, wherein x is an integer of from 1 to 20 and each R″ is independently hydrogen or methyl; $R_2$ is methyl or a group selected from the class represented by $R_1$; $R_3$ is a group selected from the class represented by R or $R_2$; and wherein said fabric softening composition further comprises 94% to 98% water.

2. A composition according to claim 1 wherein R and $R_3$ are selected from the group of aliphatic radicals containing from 12 to 18 carbon atoms.

3. A composition according to claim 2 wherein $R_2$ is a $\text{-}(CH_2CH_2O)_x\text{-}H$ group.

4. A composition according to claim 3 of the formula $$\left[R-\overset{\overset{(CH_2CH_2O)_x\text{-}H}{|}}{N}\text{-}(CH_2CH_2O)_x\text{-}H \atop \underset{R_3}{|}\right]^{+}[H_2BO_3]^-$$

wherein each x is independently an integer of from 1 to 10.

5. A composition according to claim 4 wherein each x is independently an integer of from 1 to 5.

6. A fabric softening composition comprising between 2% and 6% of the compound of the formula:

$$\left[R-\overset{\overset{R_1}{|}}{C}-R_1 \atop \underset{R_3}{|}\right]^{+}[H_2BO_3]^-,$$

wherein R and $R_3$ are selected from the class consisting of aliphatic radicals containing from about 8 to 22 carbon atoms and $R_1$ is a $$\text{-}(CH_2CH_2)_x\text{-}H$$

group wherein x is an integer of from 1 to 5, said composition further comprising 94% to 98% water, said composition being stable to freeze-thaw cycles.

7. The composition as set forth in claim 6, wherein x is 1.

8. The composition as set forth in claim 6, wherein R and $R_3$ are each the tallow alkyl group.

9. The composition as set forth in claim 7, wherein R and $R_3$ are each the tallow alkyl group.

* * * * *